US007370453B2

(12) United States Patent
Puzio

(10) Patent No.: US 7,370,453 B2
(45) Date of Patent: May 13, 2008

(54) CERAMIC MOLDING SYSTEM AND METHOD

(76) Inventor: Raymond Puzio, 217 N. Providence Rd., Wallingford, PA (US) 19086

( * ) Notice: Subject to any disclaimer, the term of this patent is extended or adjusted under 35 U.S.C. 154(b) by 0 days.

(21) Appl. No.: 10/684,699

(22) Filed: Oct. 14, 2003

(65) Prior Publication Data

US 2005/0076603 A1 Apr. 14, 2005

(51) Int. Cl.
*E04C 3/00* (2006.01)

(52) U.S. Cl. ..... 52/287.1; 52/288.1; 52/461

(58) Field of Classification Search ..... 52/461, 52/287.1, 288.1
See application file for complete search history.

(56) References Cited

U.S. PATENT DOCUMENTS 316,715 A * 4/1885 Woelfle ..... 52/288.1
323,110 A * 7/1885 Carlewitz ..... 52/288.1
342,024 A * 5/1886 Mankey ..... 52/287.1
1,917,139 A * 7/1933 McCutcheon ..... 52/254
3,201,910 A * 8/1965 Keesee ..... 52/287.1
3,309,832 A * 3/1967 Filsinger ..... 52/610
5,001,877 A * 3/1991 Edwards ..... 52/288.1
5,179,811 A * 1/1993 Walker et al. ..... 52/288.1
5,359,817 A * 11/1994 Fulton ..... 52/288.1
5,433,048 A * 7/1995 Strasser ..... 52/288.1
5,463,835 A * 11/1995 Wood ..... 52/288.1
6,755,000 B2 * 6/2004 Wone Hahn ..... 52/287.1

OTHER PUBLICATIONS

Thetiledoctor.com, "Ceramic Tile Manufacturing", World Wide Web (Internet), USA, Oct. 9, 2003.

* cited by examiner

*Primary Examiner*—Basil Katcheves
(74) *Attorney, Agent, or Firm*—RatnerPrestia

(57) ABSTRACT

A a crown molding assembly is provided. The crown molding assembly includes a wall portion and a ceiling portion meeting along a perimeter of a room or portion thereof. The crown molding assembly further includes a plurality of ceramic wall tiles secured to the wall portion proximal to the ceiling portion. A plurality of ceramic bridging tiles, each positioned adjacent one of the ceramic wall tiles, extends toward the ceiling portion. The ceramic wall tiles and the ceramic bridging tiles together form crown molding segments positioned along at least a portion of the perimeter of the room.

22 Claims, 5 Drawing Sheets

CERAMIC MOLDING SYSTEM AND METHOD

FIELD OF THE INVENTION

The present invention relates to a crown molding system and, more particularly, to a ceramic tile crown molding system adapted for use along a perimeter of a room.

BACKGROUND OF THE INVENTION

Crown molding is a popular architectural tool utilized to disguise the harsh juncture between ceilings and walls. Crown molding may add height to a room, create a domed-ceiling effect, and/or compliment a variety of decorating styles.

Crown molding is typically formed from a variety of wood species, from affordable, easy-to-cut softwoods like pine, poplar, and spruce, to expensive, less manageable hardwoods like oak. Long strips of such wood are conventionally used to cover the joint where the walls of a room meet the ceiling.

There continues to be a need for an alternative crown molding system that will conceal the severe transition between ceilings and walls while enhancing the architectural integrity of a space.

SUMMARY OF THE INVENTION

In one exemplary embodiment, this invention provides a crown molding assembly. The crown molding assembly includes a wall portion and a ceiling portion meeting along a perimeter of a room or portion thereof. The crown molding assembly further includes a plurality of ceramic wall tiles secured to the wall portion proximal to the ceiling portion. A plurality of ceramic bridging tiles, each positioned adjacent one of the ceramic wall tiles, extends toward the ceiling portion. The ceramic wall tiles and the ceramic bridging tiles together form crown molding segments positioned along at least a portion of the perimeter of the room.

In another exemplary embodiment, a crown molding system for use where a wall portion and a ceiling portion meet along a perimeter of a room or portion thereof is provided. The crown molding system includes a plurality of ceramic wall tiles configured to be secured to the wall portion proximal to the ceiling portion. The crown molding system further includes a plurality of ceramic bridging tiles, each configured to be positioned adjacent one of the ceramic wall tiles to extend toward the ceiling portion. The ceramic wall tiles and the ceramic bridging tiles together form crown molding segments positioned along at least a portion of the perimeter of the room upon securement.

In yet another exemplary embodiment, a method of installing crown molding where a wall portion and a ceiling portion meet along a perimeter of a room or portion thereof is provided. A plurality of ceramic wall tiles is secured to the wall portion proximal to the ceiling portion. A plurality of ceramic bridging tiles is positioned such that each ceramic bridging tile is adjacent one of the ceramic wall tiles and extends toward the ceiling portion, thereby forming crown molding segments positioned along at least a portion of the perimeter of the room.

In another exemplary embodiment, a crown molding assembly including a wall portion and a ceiling portion meeting along a perimeter of a room or portion thereof is provided. The crown molding assembly further includes a plurality of crown molding segments positioned along at least a portion of the perimeter of the room. Each of the segments includes a wall tile secured to the wall portion proximal to the ceiling portion and a bridging tile positioned adjacent the wall tile and extending toward the ceiling portion. A gap is defined between adjacent pairs of the crown molding segments, and the gap is filled with a filler material.

DETAILED DESCRIPTION OF THE INVENTION

Figure 1:
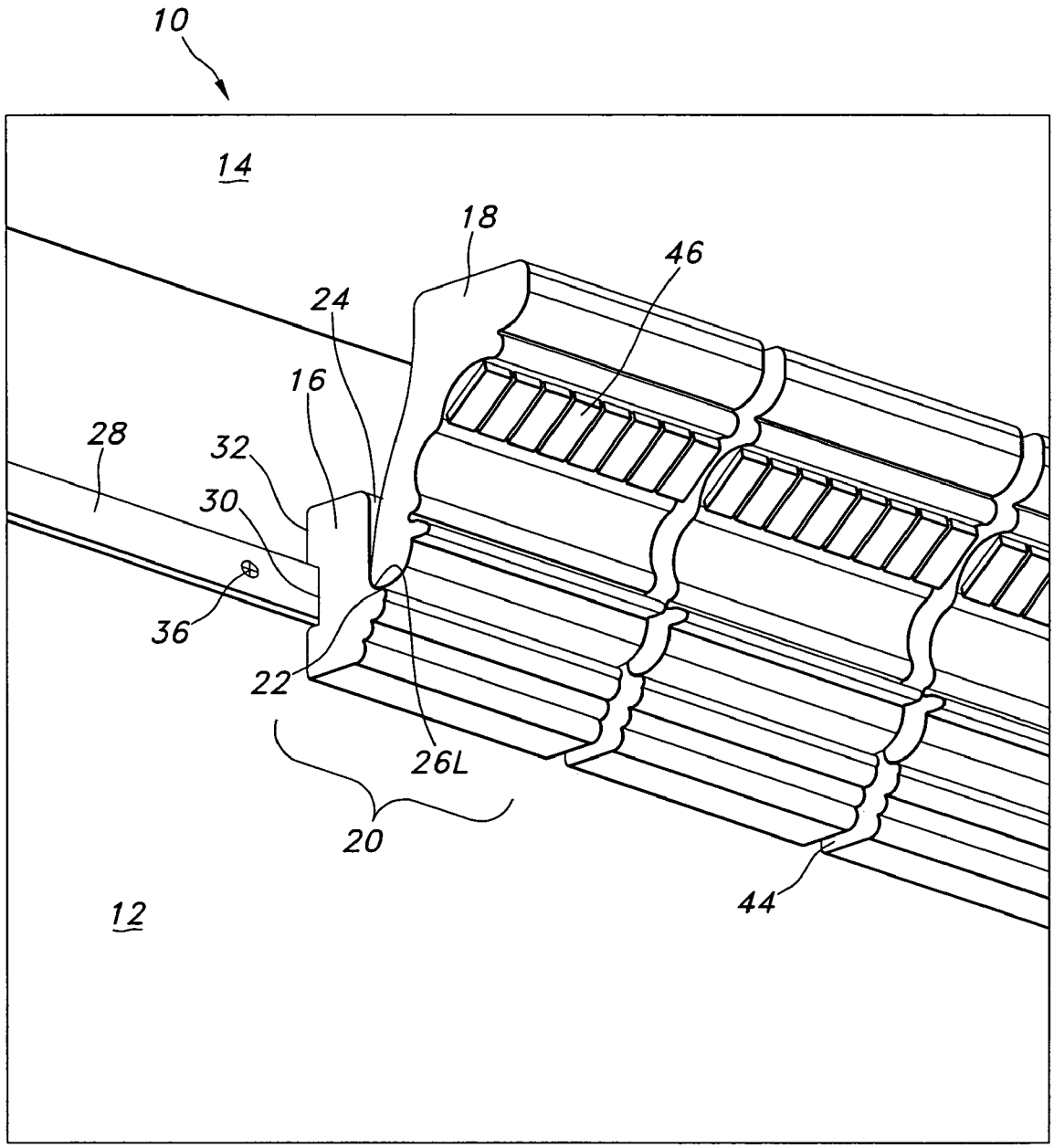
FIG. 1 is a perspective view of an exemplary embodiment of a crown molding assembly illustrating a support mounted to a wall portion according to aspects of this invention.

Although the invention is illustrated and described herein with reference to specific embodiments, the invention is not intended to be limited to the details shown. Rather, various modifications may be made in the details within the scope and range of equivalents of the claims and without departing from the invention.

Referring to the figures generally, in an exemplary embodiment a crown molding assembly 10 includes a wall portion 12 and a ceiling portion 14 meeting along a perimeter of a room or portion thereof. The crown molding assembly 10 further includes a plurality of ceramic wall tiles 16 secured to the wall portion 12 proximal to the ceiling portion 14. A plurality of ceramic bridging tiles 18, each positioned adjacent one of the ceramic wall tiles 16, extends toward the ceiling portion 14. The ceramic wall tiles 16 and the ceramic bridging tiles 18 together form crown molding segments 20 positioned along at least a portion of the perimeter of the room.

In another exemplary embodiment, a crown molding system 50 for use where a wall portion 12 and a ceiling portion 14 meet along a perimeter of a room or portion thereof is provided. The crown molding system 50 includes a plurality of ceramic wall tiles 16 configured to be secured to the wall portion 12 proximal to the ceiling portion 14. The crown molding system 50 further includes a plurality of ceramic bridging tiles 18, each configured to be positioned adjacent one of the ceramic wall tiles 16 to extend toward the ceiling portion 14. The ceramic wall tiles 16 and the ceramic bridging tiles 18 together form crown molding segments 20 positioned along at least a portion of the perimeter of the room upon securement.

In yet another exemplary embodiment, a method of installing crown molding 50 where a wall portion 12 and a ceiling portion 14 meet along a perimeter of a room or portion thereof is provided. A plurality of ceramic wall tiles 16 is secured to the wall portion 12 proximal to the ceiling portion 14. A plurality of ceramic bridging tiles 18 is positioned such that each ceramic bridging tile 18 is adjacent one of the ceramic wall tiles 16 and extends toward the ceiling portion 14, thereby forming crown molding segments 20 positioned along at least a portion of the perimeter of the room.

In another exemplary embodiment, a crown molding assembly 10 including a wall portion 12 and a ceiling portion 14 meeting along a perimeter of a room or portion thereof is provided. The crown molding assembly 10 further includes a plurality of crown molding segments 20 positioned along at least a portion of the perimeter of the room. Each of the segments 20 includes a wall tile 16 secured to the wall portion 12 proximal to the ceiling portion 14 and a bridging tile 18 positioned adjacent the wall tile 16 and extending toward the ceiling portion 14. A gap 44 is defined between adjacent pairs of the crown molding segments 20, and the gap 44 is filled with a filler material.

Referring now to FIG. 1, a crown molding assembly embodying exemplary aspects of this invention is generally designated by the numeral "10." The crown molding assembly 10 includes a wall portion 12 and a ceiling portion 14 meeting along a perimeter of a room or portion thereof. The crown molding assembly 10 further includes a plurality of ceramic wall tiles 16 secured to the wall portion 12 proximal to the ceiling portion 14. A plurality of ceramic bridging tiles 18, each positioned adjacent one of the ceramic wall tiles 16, extends toward the ceiling portion 14. The ceramic wall tiles 16 and the ceramic bridging tiles 18 together form crown molding segments 20 positioned along at least a portion of the perimeter of the room.

Each of the ceramic wall tiles 16 has a support surface 22 (illustrated more clearly in FIGS. 2 and 3) extending along an anterior surface 24 of the ceramic wall tile 16. Each ceramic wall tile 16 is positioned to support a respective ceramic bridging tile 18 at lower resting surface 26L. The lower resting surface 26L of each ceramic bridging tile 18 may simply rest on a support surface 22 of a respective ceramic wall tile 16. Alternatively, the lower resting surface 26L of each ceramic bridging tile 18 may be adhered to a support surface 22 of a respective ceramic wall tile 16. Adjacent ceramic bridging tiles may alternately (or by any other pattern) rest on and be adhered to the support surfaces 22 of respective ceramic wall tiles 16.

Similarly, the ceramic bridging tiles 18 may be secured to the ceiling portion 14 at top surface 19 by the snug fit of each crown molding segment 20. Alternatively, an adhesive may be utilized to secure the ceramic bridging tiles 18 at top surface 19 to the ceiling portion 14.

Figure 3:
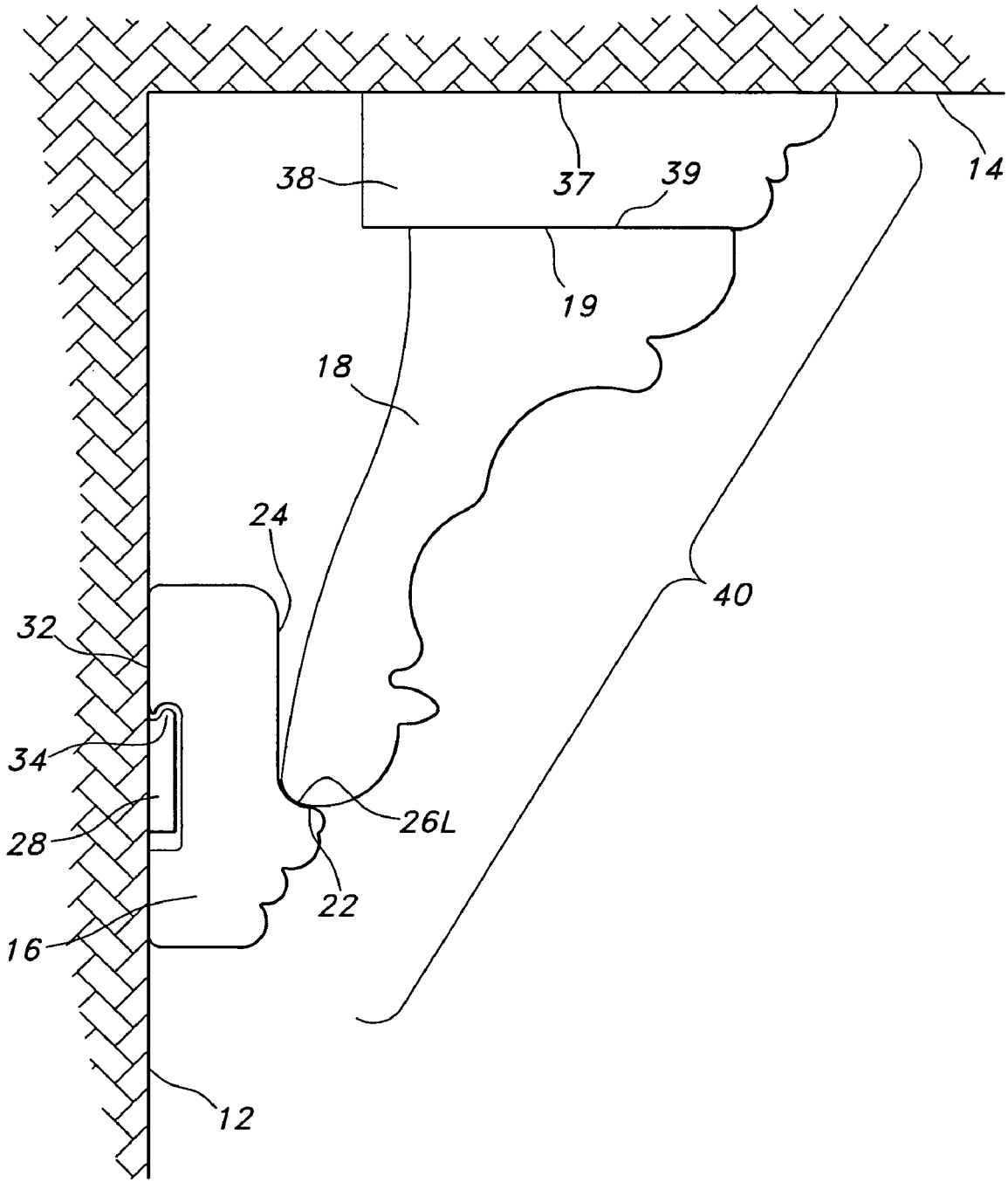
FIG. 3 is a cross-sectional side view of yet another exemplary embodiment of a crown molding assembly illustrating a support mounted to a wall portion and a ceiling tile secured to a ceiling portion according to aspects of this invention.
Figure 5:
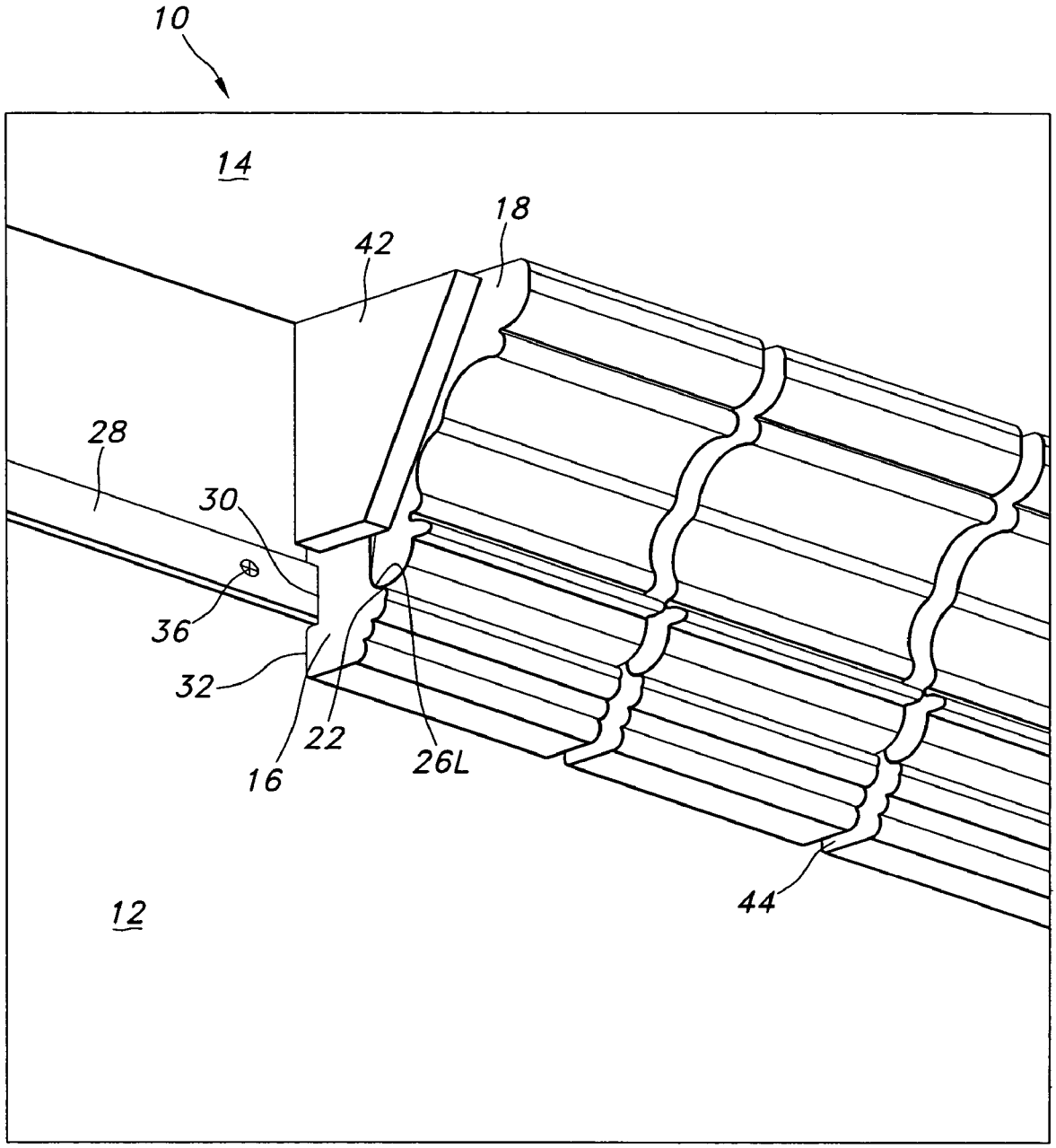
FIG. 5 is a perspective view of yet another exemplary embodiment of a crown molding assembly illustrating a spacer according to aspects of this invention.

The exemplary embodiments of the crown molding assembly 10 illustrated in FIGS. 1, 3, and 5 include an optional support 28 that is mounted to the wall portion 12. The support 28 is positioned to support the ceramic wall tiles 16. More specifically, each of the ceramic wall tiles 16 has an optional recess 30 extending along a posterior surface 32 of the ceramic wall tile 16. Each recess 30 is positioned to accommodate the support 28 mounted to the wall portion 12.

The cross-sectional shape of the support 28 is not limited to rectangular (as represented in FIGS. 1 and 5). For example, the support 28 but may include a lip 34 (as represented in FIG. 3) or comprise any other cross-sectional shape suitable for engaging the recess 30 of each ceramic wall tile 16. The support 28 may be mounted via fasteners 36 (as illustrated in FIG. 1), but is not limited to such mounting means. The exemplary support 28 represented in FIG. 3 is mounted via adhesive. Any other means suitable for adequately securing the support 28 for supporting each ceramic wall tile 16 may be utilized. Furthermore, the support 28 may be made from wood, plastic, metal, or any other suitable material of adequate strength and rigidity to support each ceramic wall tile 16.

Figure 2:
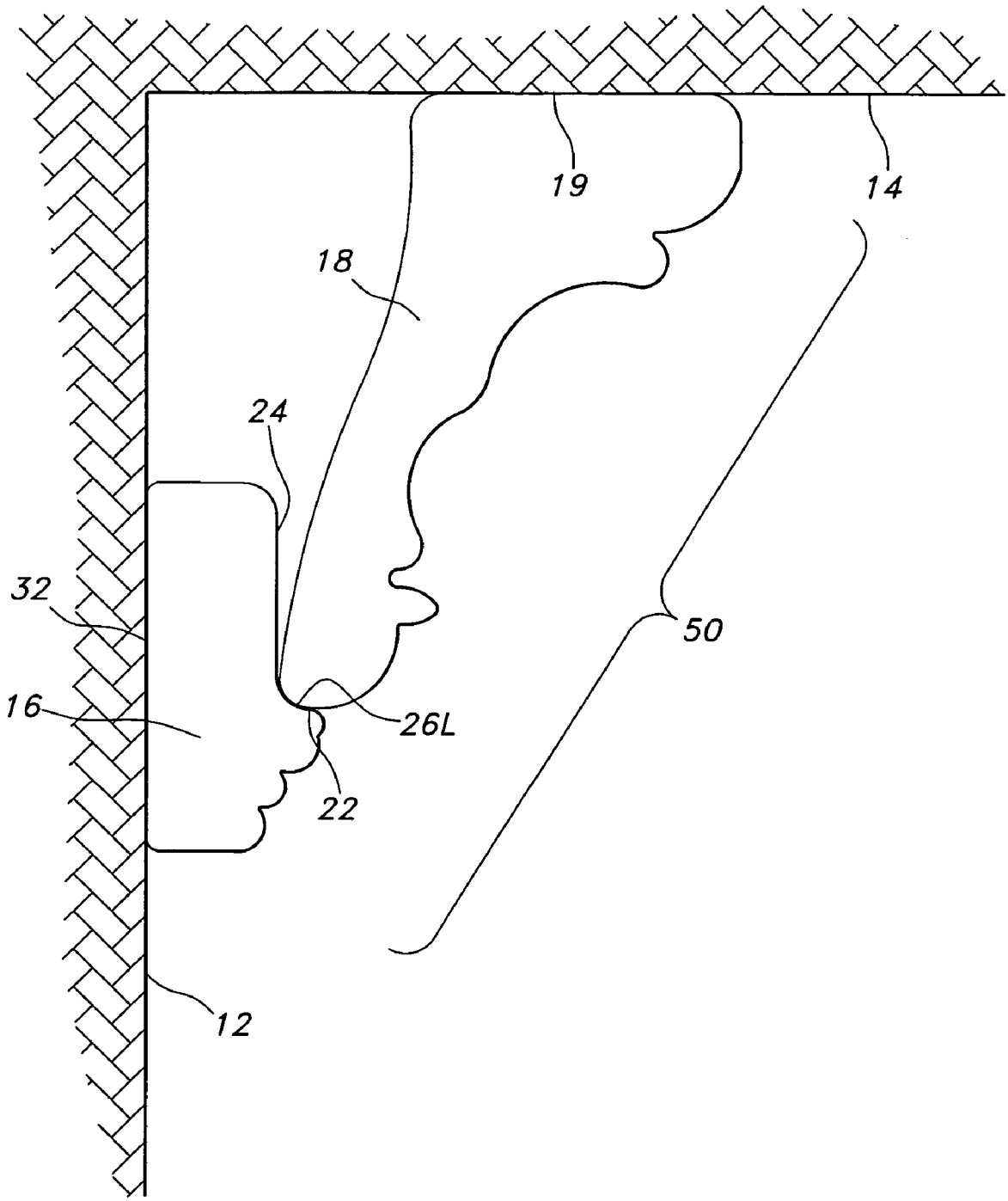
FIG. 2 is a cross-sectional side view of another exemplary embodiment of a crown molding assembly shown without a support mounted to a wall portion according to aspects of this invention.

The embodiment of the crown molding assembly 10 illustrated in FIG. 2 does not include a support 28 that is mounted to the wall portion 12. Alternatively, each ceramic wall tile 16 is secured along its posterior surface 32 to the wall portion 12 via adhesive.

Referring specifically to FIG. 3, another embodiment of the crown molding assembly 10 includes a plurality of optional ceramic ceiling tiles 38, each positioned adjacent one of the ceramic bridging tiles 18 and secured at its top surface 37 to the ceiling portion 14. In this illustrated embodiment, the ceramic wall tiles 16, the ceramic bridging tiles 18, and the ceramic ceiling tiles 38 together form crown molding segments 40 (similar to crown molding segments 20 illustrated in FIG. 1) positioned along at least a portion of the perimeter of the room.

Each ceramic bridging tile 18 may be secured at its top surface 19 to the bottom surface 39 of each ceramic ceiling tile 38 by the snug fit of each crown molding segment 40. Alternatively, an adhesive may be utilized to secure each ceramic bridging tile 18 at top surface 19 to the bottom surface 39 of each ceramic ceiling tile 38.

Figure 4:
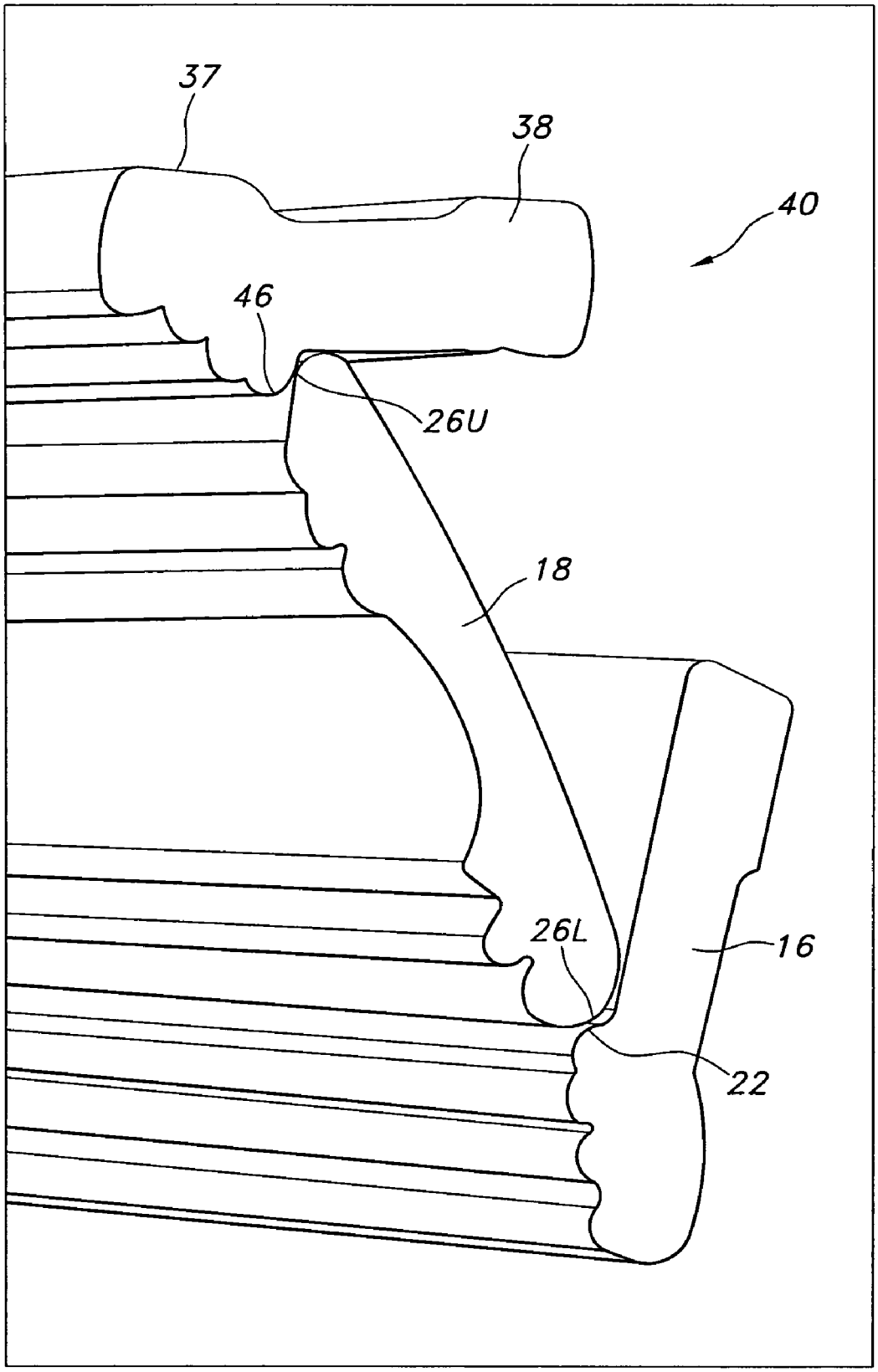
FIG. 4 illustrates a perspective view of another exemplary embodiment of a crown molding assembly shown without a support and with a ceiling tile according to aspects of this invention.

FIG. 4 illustrates yet another embodiment of the crown molding assembly 10. Similar to that shown in FIG. 3 and described previously herein, this embodiment includes a plurality of ceramic ceiling tiles 38, each positioned adjacent one of the ceramic bridging tiles 18 and secured at its top surface 37 to the ceiling portion (not shown). In this illustrated embodiment, the ceramic wall tiles 16, the ceramic bridging tiles 18, and the ceramic ceiling tiles 38 together form crown molding segments 40 (similar to crown molding segments 20 illustrated in FIG. 1) positioned along at least a portion of the perimeter of the room.

An exemplary aspect of this embodiment further includes a support surface 46 of each ceramic ceiling tile 38. The support surface 46 of each ceramic ceiling tile 38 is positioned to support a respective ceramic bridging tile 18 at its upper resting surface 26U. The upper resting surface 26U of each ceramic bridging tile 18 may simply rest on a support surface 46 of a respective ceramic ceiling tile 38. Alternatively, the upper resting surface 26U of each ceramic bridging tile 18 may be adhered to a support surface 46 of a respective ceramic ceiling tile 38.

The clearest representation of the crown molding segments 20 and 40 is crown molding segment 20 shown in FIGS. 1 and 5. The width of each crown molding segment 20 and 40, as shown, is typically about 6 inches. However, the width may range from 4 inches to 10 inches, as desired, or may be selected from any number of dimensions less than 4 inches or greater than 10 inches, as desired, depending upon design preferences.

The general shape of each crown molding segment 20 and 40, as shown, is rectangular from a viewpoint facing the wall portion 12. The height:width ratio of each crown molding segment 20 and 40, as shown, is typically about 1.2:1. However, the ratio may range from about 0.4:1 to about 4.5:1, or may be selected from any number of ratios less than 0.4:1 or greater than 4.5:1, depending upon design preferences. For example, the general shape of a particular crown molding segment 20 or 40 with a 1:1 ratio would be a square.

FIG. 5 illustrates a spacer 42 that is positioned between adjacent crown molding segments 20. Depending upon the thickness of the spacers 42, they may be utilized to ensure even spacing between adjacent crown molding segments 20. Alternatively, they may be utilized to affect a different spacing pattern between adjacent crown molding segments 20. As illustrated in FIG. 5, the profile of each spacer 42 does not extend beyond that of the crown molding segments 20. In addition to ensuring the desired spacing between adjacent crown molding segments 20, the spacers 42 also fill a void to limit the amount of adhesive (not shown) applied at gaps 44 between adjacent crown molding segments 20. The shape of each spacer 42 is not limited to that illustrated. For example, each spacer 42 may be L-shaped, triangular, or any other shape adequate to achieve the desired spacing and void-filling functions. Furthermore, each spacer 42 may be made from foam, wood, plastic, metal, rubber, or any other material suitable for achieving the desired spacing and void-filling functions The profiles of the ceramic wall tiles 16, the ceramic bridging tiles 18, and the ceramic ceiling tiles 38 are not limited to those illustrated, and may be varied as desired. Furthermore, the present invention is not limited to the ceramic wall tiles 16, the ceramic bridging tiles 18, and the ceramic ceiling tiles 38 as described previously herein. Each crown molding segment 40 may include numerous ceramic bridging tiles to achieve various profiles. Moreover, various accents, ornamental features, or facades such as an optional ceramic dental tile strip 46 (illustrated in FIG. 1) may be utilized as well.

Similarly, the present invention is not limited to the combinations illustrated and described previously herein. In other words, the crown molding assembly 10 may include any combination of the exemplary features. For example, the crown molding assembly 10 may include a ceramic wall tile 16 without a support 28, with a ceramic bridging tile 18, and with a ceramic ceiling tile 38. Alternatively, the crown molding assembly 10 may include a ceramic wall tile 16 with a support 28, with a ceramic bridging tile 18, and without a ceramic ceiling tile 38.

The various surfaces secured throughout the crown molding assembly 10 are not limited to the means described previously herein. In other words, although all surfaces may be secured with an adhesive, alternatively some may be secured with an adhesive while others may be snug fit without the use of adhesive.

The ceramic tiles (16, 18, and 38) are formed from primarily clay, talc, and other minerals. The tiles may be manufactured utilizing a number of traditional methods. For example, the tiles may be formed via a dust press method, in which an almost dry mixture of clay, talc, and other ingredients is pressed into a mold at extremely high pressures. Another method through which the tiles may be formed is an extrusion method, in which the ingredients are slightly wetter and are forced through a nozzle to form the desired tile shape. Yet another method through which the tiles may be formed is a slosh mold or wet pour method, in which a much wetter mixture of ingredients is poured into a mold to form the desired shape. Another method through which the tiles may be formed is a ram press method, which is very similar to the dust press method except that the size of the tile shapes are generally much larger.

The tiles are then dried before kiln hardening. The tiles may be glazed using a single or double firing method, i.e., the tile body and glaze may be fired simultaneously or the tile may be fired first, glaze may then be applied, and then the tile is fired a second time. The glaze is applied by either spray or waterfall methods to the surface of the tile. When the body of the tile does not possess the color desired through and through (if applicable), the use of an enrobe is necessary. Enrobe is applied just prior to the glaze and imparts color or opacity to the tile body.

The adhesive utilized throughout the crown molding assembly may be one which is known in the art. For example, the adhesive may be one of a variety of pasty cements such as mastic cement. When the adhesive applied at gaps 44 has sufficiently cured, grout may be applied to finish the gaps 44. Any of a variety of thin mortars used for filling spaces may utilized.

While preferred embodiments of the invention have been shown and described herein, it will be understood that such embodiments are provided by way of example only. Numerous variations, changes and substitutions will occur to those skilled in the art without departing from the spirit of the invention. For example, the material of the wall tiles 16, the bridging tiles 18, and the ceiling tiles 38 is not limited to ceramic. The tiles may be formed from wood, plastic, plaster, foam, composite material, or any other material conducive to providing a desired profile shape. Accordingly, it is intended that the appended claims cover all such variations as fall within the spirit and scope of the invention.

What is claimed is:

1. A crown molding assembly comprising:

a wall and a ceiling meeting along a perimeter of a room or portion thereof;

a plurality of ceramic wall tiles secured to said wall proximal to said ceiling, each said ceramic wall tile having an outwardly extending support surface below a top of said ceramic wall tile;

a plurality of ceramic bridging tiles, each said ceramic bridging tile having a lower resting surface positioned on said support surface of one of said ceramic wall tiles and having a top surface extending to said ceiling, wherein said ceramic wall tiles and said ceramic bridging tiles together form crown molding segments positioned along at least a substantially planar portion of said perimeter of said room; and a spacer positioned between adjacent crown molding segments positioned along the substantially planar portion of the perimeter of the room and forming a gap between said adjacent crown molding segments, said adjacent crown molding segments both being positioned along the same plane, and said spacer being oriented to extend in a direction substantially perpendicular to said plane.

2. The crown molding assembly of claim 1, wherein said support surface of each said ceramic wall tile extends along an anterior surface of said ceramic wall tile.

3. The crown molding assembly of claim 2, wherein at least one of said cermaic bridging tiles is adhered to said support surface of one of said ceramic wall tiles.

4. The crown molding assembly of claim 1 further comprising:

a support mounted to said wall and positioned to support at least one of said ceramic wall tiles.

5. The crown molding assembly of claim 4, wherein each of said ceramic wall tiles has a recess extending along a posterior surface of said ceramic wall tile and positioned to accommodate said support mounted to said wall.

6. The crown molding assembly of claim 1 further comprising:

a plurality of ceramic ceiling tiles, each positioned adjacent one of said ceramic bridging tiles and secured to said ceiling, each said ceramic ceiling tile extending between one of said ceramic bridging tiles and said ceiling;

wherein said ceramic wall tiles, said ceramic bridging tiles, and said ceramic ceiling tiles together form crown molding segments positioned along at least a portion of said perimeter of said room.

7. The crown molding assembly of claim 1 further comprising:

an adhesive securing said ceramic wall tiles to said wall.

8. The crown molding assembly of claim 1, wherein said ceramic bridging tiles are secured to said ceiling.

9. The crown molding assembly of claim 8 further comprising:

an adhesive securing said ceramic bridging tiles to said ceiling.

10. The crown molding segment assembly of claim 1, wherein a profile of said spacer does not extend beyond that of the adjacent crown molding segments.

11. The crown molding segment assembly of claim 1, said spacer being formed from a material selected from the group consisting of foam, wood, plastic, metal, and rubber.

12. The crown molding segment assembly of claim 1, further comprising a filler material positioned in a gap defined between the adjacent crown molding segments.

13. A method of installing crown molding where a wall and a ceiling meet along a perimeter of a room or portion thereof, said method comprising the steps of:

securing a plurality of ceramic wall tiles to the wall proximal to the ceiling;

positioning a plurality of ceramic bridging tiles such that a lower resting surface of each ceramic bridging tile is on an outwardly extending support surface below a top of one of the ceramic wall tiles and such that each ceramic bridging tile extends from the outwardly extending support surface to the ceiling, thereby forming crown molding segments positioned along at least a substantially planar portion of the perimeter of the room; and positioning a spacer between adjacent crown molding segments positioned along the substantially planar portion of the perimeter of the room to form a gap between the adjacent crown molding segments, said adjacent crown molding segments both being positioned along the same plane, and the spacer being oriented to extend in a direction substantially perpendicular to said plane.

14. The method of claim 13 further comprising the step of:

supporting a ceramic bridging tile on a support surface extending along an anterior surface of a respective ceramic wall tile.

15. The method of claim 14 further comprising the step of:

adhering at least one of the ceramic bridging tiles to the support surface of one of the ceramic wall tiles.

16. The method of claim 13 further comprising the step of:

mounting a support to the wall for supporting at least one of the ceramic wall tiles.

17. The method of claim 16 further comprising the step of:

positioning the support mounted to the wall within a recess extending along a posterior surface of the ceramic wall tile.

18. The method of claim 13 further comprising the step of:

securing a plurality of ceramic ceiling tiles adjacent the ceramic bridging tiles and to the ceiling, each said ceramic ceiling tile extending between one of said ceramic bridging tiles and said ceiling, thereby forming crown molding segments positioned along at least a portion of the perimeter of the room.

19. The method of claim 13 further comprising the step of:

securing the ceramic wall tiles to the wall with an adhesive.

20. The method of claim 13 further comprising the step of:

securing the ceramic bridging tiles to the ceiling.

21. The method of claim 13 further comprising the step of:

securing the ceramic bridging tiles to the ceiling with an adhesive.

22. A crown molding assembly comprising:

a wall and a ceiling meeting along a perimeter of a room or portion thereof;

a plurality of ceramic crown molding segments positioned along at least a substantially planar portion of the perimeter of the room, each of said segments including:

a wall tile secured to said wall proximal to said ceiling and having an outwardly extending support surface below a top of said wall tile; and a bridging tile having a lower resting surface positioned on said support surface of said wall tile and extending toward said ceiling;

a ceiling tile positioned between said bridging tile and said ceiling and secured to said ceiling; and a spacer positioned between adjacent crown molding segments positioned along the substantially planar portion of the perimeter of the room, said adjacent crown molding segments both being positioned along the same plane, said spacer being oriented to extend in a direction substantially perpendicular to said plane, wherein a gap is defined by said spacer between adjacent crown molding segments and said gap is filled with a filler material.

* * * * *